US006204834B1

(12) United States Patent
Baker et al.

(10) Patent No.: US 6,204,834 B1
(45) Date of Patent: Mar. 20, 2001

(54) SYSTEM AND METHOD FOR ACHIEVING UNIFORM SCREEN BRIGHTNESS WITHIN A MATRIX DISPLAY

(75) Inventors: Robert C. Baker, Austin; William J. Donoghue, Round Rock; Stephen H. Kelley; Claude Hilbert, both of Austin, all of TX (US)

(73) Assignee: SI Diamond Technology, Inc., Austin, TX (US)

( * ) Notice: Subject to any disclaimer, the term of this patent is extended or adjusted under 35 U.S.C. 154(b) by 0 days.

(21) Appl. No.: 08/292,135

(22) Filed: Aug. 17, 1994

(51) Int. Cl.[7] ..... G09G 3/32

(52) U.S. Cl. ..... 345/74; 345/147; 315/169.1

(58) Field of Search ..... 345/63, 74, 75, 345/76, 77, 78, 89, 101, 147, 58, 148; 315/169.3, 169.1, 307, 308, 309, 297

(56) References Cited

U.S. PATENT DOCUMENTS

| | | |
|---|---|---|
| 3,665,241 | 5/1972 | Spindt et al. . |
| 3,675,063 | 7/1972 | Spindt et al. . |
| 3,755,704 | 8/1973 | Spindt et al. . |
| 3,789,471 | 2/1974 | Spindt et al. . |
| 3,812,559 | 5/1974 | Spindt et al. . |
| 4,084,942 | 4/1978 | Villalobos . |
| 4,141,405 | 2/1979 | Spindt . |
| 4,143,292 | 3/1979 | Hosoki et al. . |
| 4,168,213 | 9/1979 | Hoeberechts . |
| 4,178,531 | 12/1979 | Alig . |
| 4,307,507 | 12/1981 | Gray et al. . |
| 4,513,308 | 4/1985 | Greene et al. . |
| 4,528,474 | 7/1985 | Kim . |
| 4,822,466 | 4/1989 | Rabalais et al. . |
| 4,851,254 | 7/1989 | Yamamoto et al. . |
| 4,857,799 | 8/1989 | Spindt et al. . |

(List continued on next page.)

FOREIGN PATENT DOCUMENTS 88 07288 12/1989 (FR) .

OTHER PUBLICATIONS

Data Sheet on Andoe Driver, SN755769, pp. 4–81 to 4–88, Texas Instruments.

Data Sheet on Display Driver, HV38, Supertex Inc., pp. 11–43 to 11–50.

Data Sheet on Voltage Driver, HV620, Supertex Inc., pp. 1–6, May 21, 1993.

Data Sheet on Voltage Driver, HV622, Supertex Inc., pp. 1–5, Sep. 22, 1992.

*Primary Examiner*—Regina Liang
(74) *Attorney, Agent, or Firm*—Kelly K. Kordzik; Winstead Sechrest & Minick P.C.

(57) ABSTRACT

A system and method for producing uniform energy dissipation in display pixels with widely varying electrical characteristics in order to equalize light output and improve yield within a matrix addressable display panel. The present invention is implemented within a driver circuit utilizing the concept of current integration. A reference voltage, which is proportional to the most efficient pixel within the display is compared to the energy dissipated within a particular pixel during illumination of that pixel. A current mirror circuit supplies a current equivalent to the current provided to the object pixel to an integrator circuit resulting in a rising voltage within the integrator circuit. The rising voltage is proportional to the energy being dissipated within the current pixel. Once the rising voltage is equal to or greater than the reference voltage, current is removed from the object pixel.

57 Claims, 7 Drawing Sheets

U.S. PATENT DOCUMENTS 4,874,981 10/1989 Spindt .
4,897,639 * 1/1990 Kanayama ..... 345/148
4,926,056 5/1990 Spindt .
4,940,916 7/1990 Borel et al. .
4,990,766 2/1991 Simms et al. .
5,015,912 5/1991 Spindt et al. .
5,054,046 10/1991 Shoulders .
5,054,047 10/1991 Shoulders .
5,064,396 11/1991 Spindt .
5,075,591 12/1991 Holmberg .
5,075,596 12/1991 Young et al. .
5,089,292 2/1992 MaCaulay et al. .
5,089,812 2/1992 Fuse et al. .
5,101,288 3/1992 Ohta et al. .
5,111,195 * 5/1992 Fukuoka et al. .
5,117,267 5/1992 Kimoto et al. .
5,117,299 5/1992 Kondo et al. .
5,119,386 6/1992 Narusawa .
5,123,039 6/1992 Shoulders .
5,129,850 7/1992 Kane et al. .
5,132,585 7/1992 Kane et al. .
5,132,676 7/1992 Kimura et al. .
5,138,237 8/1992 Kane et al. .
5,141,459 8/1992 Zimmerman .
5,141,460 8/1992 Jaskie et al. .
5,142,184 8/1992 Kane .
5,142,390 8/1992 Ohta et al. .
5,148,461 9/1992 Shoulders .
5,151,061 9/1992 Sandhu .
5,153,753 10/1992 Ohta et al. .
5,153,901 10/1992 Shoulders .
5,157,525 * 10/1992 Faton et al. ..... 345/147
5,162,704 11/1992 Kobori et al. .
5,180,951 1/1993 Dworsky et al. .
5,183,529 2/1993 Potter et al. .
5,186,670 2/1993 Doan et al. .
5,199,917 4/1993 MacDonald et al. .
5,202,571 4/1993 Hinabayashi et al. .
5,203,731 4/1993 Zimmerman .
5,204,581 4/1993 Andreadakis et al. .
5,210,430 5/1993 Taniguchi et al. .
5,212,426 5/1993 Kane .
5,214,416 5/1993 Kondo et al. .
5,228,877 7/1993 Allaway et al. .
5,228,878 7/1993 Komatsu .
5,229,331 7/1993 Doan et al. .
5,229,682 7/1993 Komatsu .
5,235,244 8/1993 Spindt .
5,243,252 9/1993 Kaneko et al. .
5,250,451 10/1993 Chouan .
5,252,833 10/1993 Kane et al. .
5,256,888 10/1993 Kane .
5,259,799 11/1993 Doan et al. .
5,275,967 1/1994 Taniguchi et al. .
5,276,521 1/1994 Mori .
5,277,638 1/1994 Lee .
5,278,475 1/1994 Jaskie et al. .
5,281,891 1/1994 Kaneko et al. .
5,283,500 2/1994 Kochanski .
5,285,129 2/1994 Takeda et al. .
5,312,512 5/1994 Allman et al. .
5,449,970 * 9/1995 Kumar et al. ..... 345/75

* cited by examiner

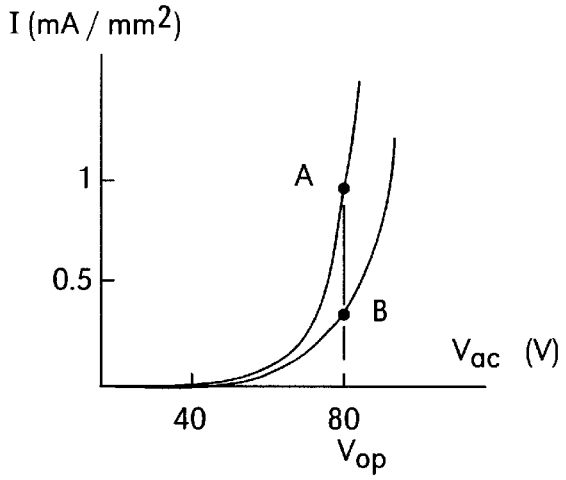

Fig. 5

| SYMBOL | PARAMETER | MIN | MAX | UNIT |
|---|---|---|---|---|
| $t_{AN_cyc}$ | ANODE DRIVER CYCLE | 10 | | μsec |
| $t_{WDPLS}$ | DPLS HIGH PULSE DURATION (DELAY TO ALLOW ANODE PRECHARGE) | 300 | 500 | nsec |
| $t_{CMP_pre}$ | DPLS HIGH TO COMPUTER PRECHARE STATE | | 10 | nsec |
| $t_{AN_pre}$ | ANODE PRECHARGE TIME | | 500 | nsec |
| $t_{PWM_dly}$ | DPLS LOW TO PWM GOING LOW DELAY | | 5 | nsec |
| $t_{WPWM}$ | PWM PULSE WIDTH DURATION | 0 | 3 | μsec |
| $t_{CTHD_dly}$ | DPLS LOW TO CATHODE DRIVER TURNING ONE | | 10 | nsec |
| $t_{CM_dly}$ | DPLS LOW TO CM[0:35] CURRENT FLOW ON | | 5 | nsec |
| $t_{CM_chrg}$ | CM[0:35] CHARGING TIME | 0 | 9 | μsec |
| $t_{CMP_on}$ | COMPARATOR ON TIME | 0 | 9 | μsec |
| $t_{AN_cmp}$ | ANODE COMPENSATING ON TIME PAST PWM ON | 0 | 6 | μsec |
| $t_{AN_exp}$ | ANODE EXPOSURE ("ON") TIME | 0 | 9 | μsec |
| $t_{LD_dly}$ | LEVEL DETECTOR DELAY FROM CM[0:35] GOING TO 5V | | 10 | nsec |

Fig. 6

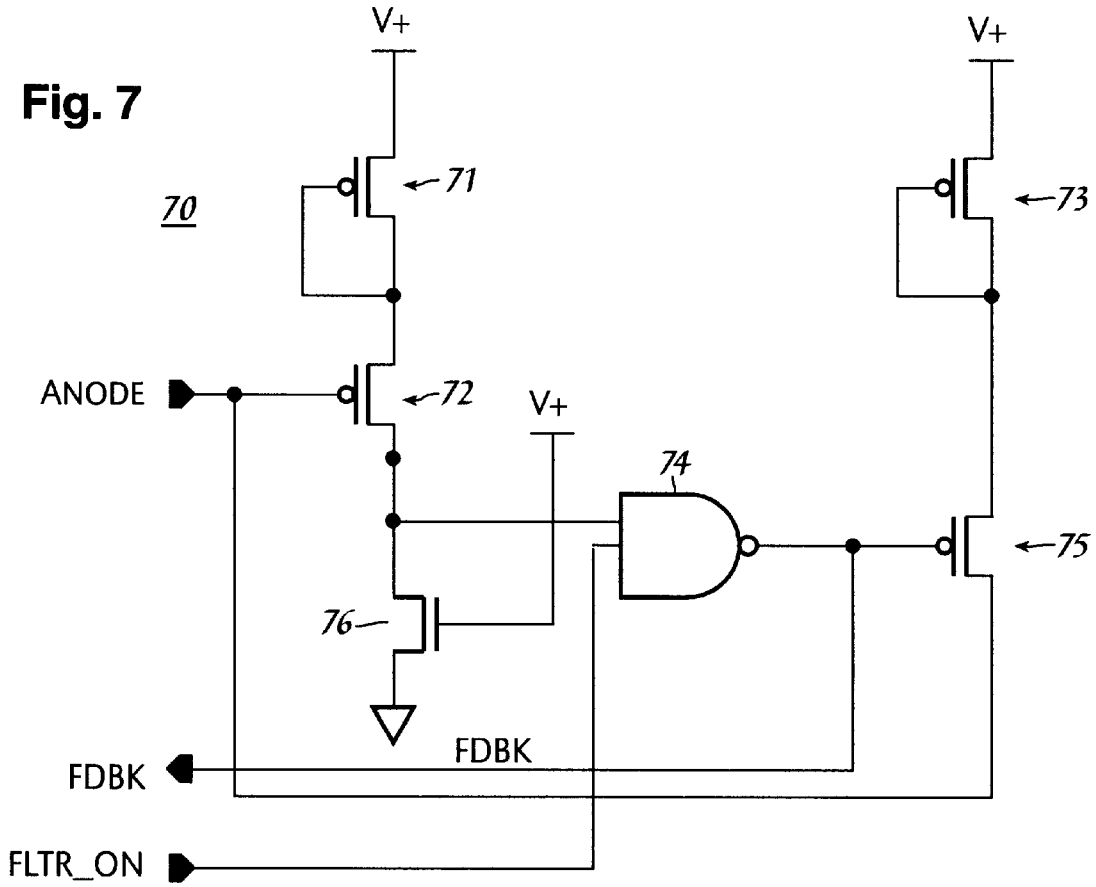
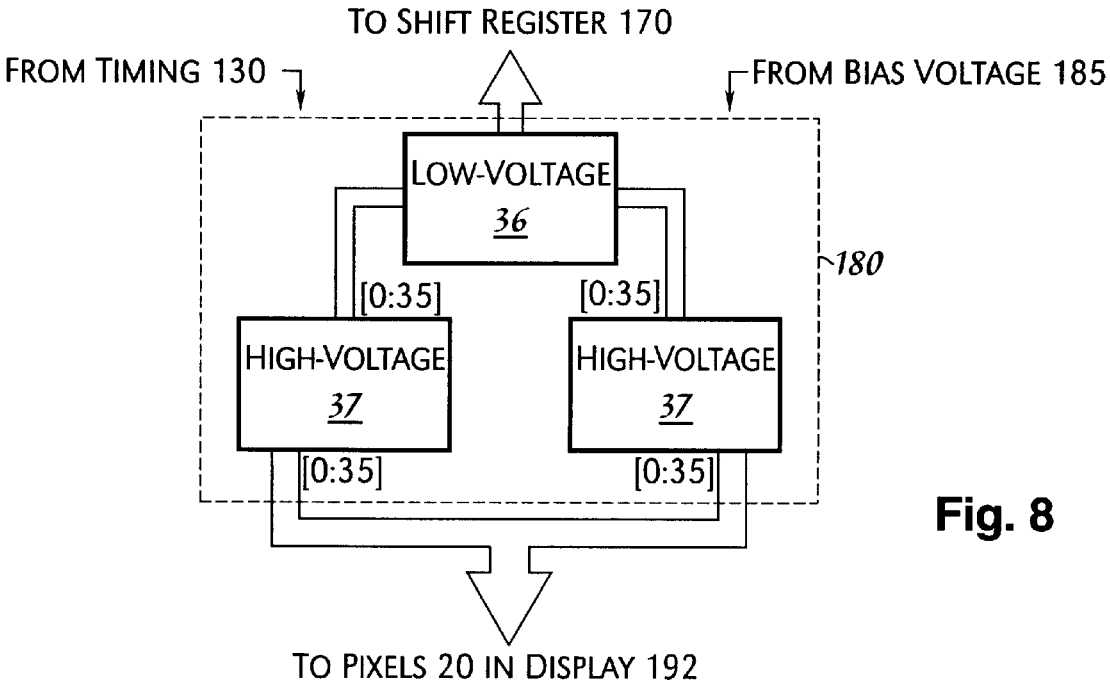
Fig. 8

SYSTEM AND METHOD FOR ACHIEVING UNIFORM SCREEN BRIGHTNESS WITHIN A MATRIX DISPLAY

TECHNICAL FIELD OF THE INVENTION

This invention relates to data processing systems and specifically to display devices for such systems.

BACKGROUND OF THE INVENTION

Conventional cathode ray tubes (CRTs) are used in display monitors for computers, television sets, and other video devices to visually display information. Use of a luminescent phosphor coating on a transparent face, such as glass, allows the CRT to communicate qualities such as color, brightness, contrast and resolution which, together, form a picture for the benefit of a viewer.

Conventional CRTs have, among other things, the disadvantage of requiring significant physical depth, i.e. space behind the actual display screen, resulting in such units being large and cumbersome. There are a number of important applications in which this physical depth is deleterious. For example, the depth available for many compact portable computer displays precludes the use of conventional CRTs. Furthermore, portable computers cannot tolerate the additional weight and power consumption of conventional CRTs. To overcome these disadvantages, displays have been developed which do not have the depth, weight or power consumption of conventional CRTs. These "flat panel" displays have thus far been designed to use technologies such as passive or active matrix liquid-crystal displays ("LCD") or electroluminescent ("EL") or gas plasma displays.

A flat panel display fills the void left by conventional CRTs. However, the flat panel displays based on liquid-crystal technology either produce a picture that is degraded in its fidelity or is non-emissive. Some liquid-crystal displays have overcome the non-emissiveness problem by providing a backlight, but this has its own disadvantage of requiring more energy. Since portable computers typically operate on limited battery power, this becomes an extreme disadvantage. The performance of passive matrix LCDs may be improved by using active matrix LCD technology, but the manufacturing yield of such displays is very low due to required complex processing controls and tight tolerances. EL and gas plasma displays are brighter and more readable than liquid-crystal displays, but are more expensive and require a significant amount of energy to operate.

A solution has been found in field emission displays, which combine the visual display advantages of the conventional CRT with the depth, weight and power consumption advantages of more conventional flat panel liquid-crystal, EL and gas plasma displays. Within such field emission displays, electrons are emitted from a cold electron emitter electrode due to the presence of an electric field applied across the electrodes comprising the display, which bombard a phosphor coated anode, thereby generating light. Such a matrix-addressed flat panel display is taught in U.S. Pat. No. 5,015,912, which issued on May 14, 1991, to Spindt et al., which is hereby incorporated by reference herein, and which uses micro-tip cathodes of the field emission type.

Additionally, please refer to U.S. patent application Ser. No. 07/851,701, filed Mar. 16, 1992 and entitled "Flat Panel Display Based on Diamond Thin Films," U.S. patent application Ser. No. 07/993,863, filed Dec. 23, 1992 and entitled "Triode Structure Flat Panel Display Employing Flat Field Emission Cathodes," U.S. patent application Ser. No. 07/995,847, filed Dec. 23, 1992 and entitled "Diode Structure Flat Panel Display," U.S. patent application Ser. No. 08/071,157, filed Jun. 2, 1993, and entitled "Amorphic Diamond Film Flat Field Emission Cathode," U.S. Pat. No. 5,199,918, issued Apr. 6, 1993 and entitled "Method of Forming Film Emitter Device with Diamond Emission Tips, "and U.S. Pat. No. 5,312,514, issued May 17, 1994 and entitled "Method of Making a Field Emitter Device Using Randomly Located Nuclei as an Etch Mask," which applications and patents have been filed or have been granted to a common assignee and are hereby incorporated by reference herein, for further discussions on cold cathode field emission displays and related technology.

Field emission display panels have pixels that efficiently produce light at low level currents on the order of tens of microamps ("$\mu$A"). These pixels' voltage-to-current relationship may have random noise, threshold variations, soft forward knees and several hundred volt turn-on characteristics. Furthermore, the X-Y organization lines in the display have parasitic capacitances. Moreover, according to the well-known Fowler-Nordheim ("F-N") theory, the current density of field emissions changes by as much as 10 percent when cathode/anode separation changes by only 1 percent. Further, red, green and blue phosphors often have different efficiencies. All of these variations can cause adjacent or distant discreet pixels to have widely varying light outputs when driven with either constant currents or constant voltages. FIG. 5 illustrates an example of the fluctuations in the response of the current flowing across a pixel anode (corresponding to the emission of electrons from a cathode) as a function of the difference in the potentials between electrodes corresponding to a particular pixel within a matrix addressable flat panel display. Two curves are shown for two different screen pixels, A and B. The curves do not exhibit the same characteristics. It can be seen that for the same difference in potentials (Vop=80 volts), pixel A is brighter than pixel B.

In order to obtain a high yield for flat panel displays with large pixel counts, it is essential that variations in pixel performance be compensated so that variations in pixel uniformity can be tolerated. Otherwise, various pixels within the display that are less efficient, or less "hot," will not be as bright as other pixels when energized with the same amount of energy. Because of the essential purpose of a display, it is imperative that a display panel have no "bad" pixels.

Prior flat panel displays have not been completely successful in overcoming the problem of field emission variations. Other display technologies with highly non-linear electrical response characteristics have similar problems.

Thus, there is a need in the art for flat panel displays having substantially uniform pixel brightness. There is a further need in the art for a field emission flat panel display having pixels with substantially equal brightness capabilities and operating at constant voltages. There is also a need in the art for flat panel displays wherein variations and light output of pixels are equalized in the presence of parasitics that cause drive voltages to be slow and power consumptive.

SUMMARY OF THE INVENTION

Thus, it is an object of the present invention to equalize variations in light output of pixels within a flat panel display.

In obtainment of the above object, the present invention equalizes the energy applied to each pixel to the energy applied to a reference pixel within the display. The reference pixel may be the most efficient, or "hottest" pixel (highest current pixel at a fixed voltage) within the display. As energy is applied to each pixel within the display, the current applied to the pixel is sensed and mirrored through an integrating circuit, producing a rising voltage across the integrating circuit. This rising voltage is compared to an integrated reference current (which is proportional to the energy applied to the reference pixel). When the two voltages are equal, a signal is sent to the drive circuitry to remove the energy being applied to the particular pixel being activated.

In a preferred embodiment, the present invention is implemented within the circuitry utilized to drive one of the electrodes comprising the field emission display pixel. Such a pixel may be implemented within a diode configuration. However, the concepts utilized within the present invention may be implemented within any other pixel structure, e.g., triode, pentode, et seq. Since the display panel is of a matrix addressable configuration, each pixel may be separately addressed by the driver circuitry.

In a preferred embodiment of the present invention, only one of the electrodes, either the anode or the cathode, is activated with the driver circuit utilizing the present invention. A particular pixel is activated (i.e., electrons are emitted from the cathode to the anode) when the voltage across the anode and cathode is sufficient to overcome the threshold voltage required for electron emissions. In a preferred embodiment of the present invention, both the anode and the cathode are biased to preselected voltages. Only when both the anode and the cathode are addressed, is the voltage difference between the anode and the cathode made sufficiently large to overcome this threshold.

Utilizing the fact that a pixel's brightness is dependent upon the amount of energy applied to the pixel, and since constant voltages are applied between the anode and the cathode, each pixel's brightness may be varied by shortening or lengthening the pulse-width modulated signal. The present invention utilizes this principle by referencing the pulse-width modulated signal to the "hottest" pixel within the display, as described above (the "hottest" pixel may be chosen empirically during design of the particular panel within which the pixel resides, or may be dynamically selected during operation of the display), and then by sensing the energy applied to a particular pixel within the display and comparing this energy to the energy drawn by the "hottest" pixel. Essentially, the present invention equalizes the amount of charge emitted from each pixel within the display. As a result, for a desired brightness within a particular pixel, each pixel within the display will have a substantially equal brightness.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWING

For a more complete understanding of the present invention, and the advantages thereof, reference is now made to the following descriptions taken in conjunction with the accompanying drawings, in which:

FIG. 5 illustrates fluctuations in the response of current flowing across various pixels within a display panel;

FIG. 6 illustrates a legend of the timing parameters illustrated in FIG. 4;

FIG. 7 illustrates a noise filter utilized within the present invention;

FIG. 8 illustrates the present invention as implemented within low and high voltage chips;

DETAILED DESCRIPTION OF A PREFERRED EMBODIMENT OF THE INVENTION

Figure 1:
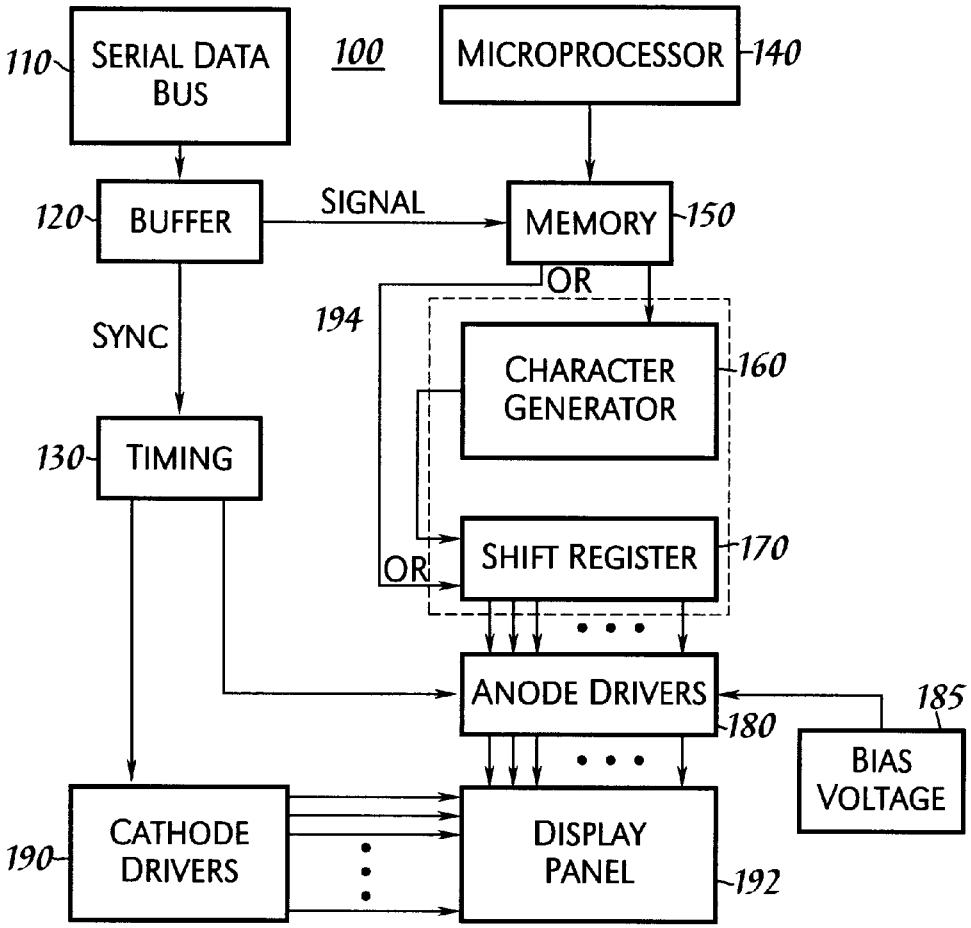
FIG. 1 illustrates a schematic block diagram of a flat panel display system.

Referring to FIG. 1, there is shown a schematic diagram of a typical system 100 for implementing a matrix-addressed flat panel display embodying the present invention. Typically, data representing video, video graphics or alphanumeric characters arrives into system 100 via serial data bus 110 where it is transferred through buffer 120 to memory 150. Buffer 120 also produces a synchronization (sync) signal which it passes on to timing circuit 130.

Microprocessor 140 controls the data within memory 150. If the data is video and not information defining alphanumeric characters, it is passed directly to shift register 170 as bit map data as represented by flow line 194. Shift register 170 uses the received bit map data to actuate anode drivers 180. Voltage driver 185 supplies a bias voltage to anode drivers 180 in a manner which is further explained in more detail in U.S. patent application Ser. No. 07/995,847 referenced above. Cathode drivers 190 may also have a bias voltage applied therein.

If the data arriving into system 100 consists of alphanumeric characters, microprocessor 140 transfers this data from memory 150 into character generator 160 which feeds the requisite information defining the desired character to shift register 170 which controls operation of anode driver 180. Shift register 170 also performs the task of refreshing the images presented to display panel 192.

Anode drivers 180 and cathode drivers 190 receive timing signals from timing circuit 130 in order to synchronize operation of anode drivers 180 and cathode drivers 190. Only anode drivers 180 are concerned with the actual data and corresponding bit map images to be presented by display panel 192. Cathode drivers 190 are simply concerned with providing synchronization with anode drivers 180 to provide the desired image on display panel 192.

In an alternative embodiment of system 100 shown in FIG. 1, serial data bus 110 simply determines the mode of presentation on display panel 192, such as screen resolution, color, or other attributes. For example, buffer 120 would use this data to provide the proper synchronization signal to timing circuit 130 which would then provide timing signals to anode drivers 180 and cathode drivers 190 in order to provide the correct synchronization for the image to be displayed. Microprocessor 140 would provide the data to be presented to memory 150 which would then pass on any video or video graphics data to shift register 170, or transfer alphanumeric data to character generator 160. Shift register 170, anode drivers 180 and cathode drivers 190 would operate as previously described to present the proper images onto display panel 192.

Display panel 192 may be of a diode, triode, pentode, et seq. configuration (refer to above referenced U.S. patent application Ser. No. 07/993,863 for a discussion on multi-electrode display configurations). Furthermore, the various driver circuitry described herein, and the circuitry comprising the present invention, may be utilized to drive the "anode", "cathode" or any of the other various electrodes used to induce emission of electrons within display panel 192. Alternatively, display panel 192 may consist of almost any matrix addressable display panel having individually addressable pixels therein. Anode drivers 180 and cathode drivers 190 would then consist of the appropriate drivers for addressing each one of these pixels within display panel 192. Furthermore, display panel 192 may be a monochrome or color display. In a further alternative embodiment of the present invention, anode drivers 180 and/or cathode drivers 190 may consist of both low voltage and high voltage driver circuits.

Figure 2:
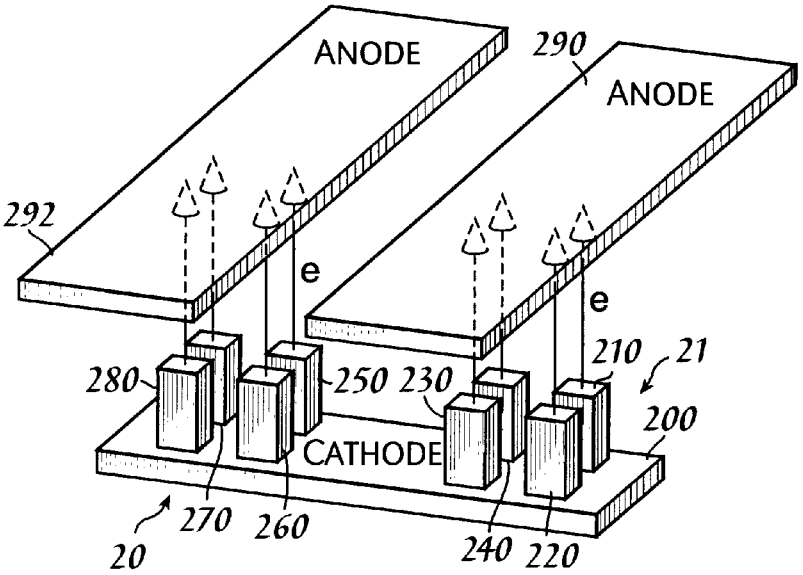
FIG. 2 illustrates individual pixels within a flat panel display system.

Referring next to FIG. 2, there is shown a typical operation of pixel sites 20 and 21 within display panel 192 implemented in a diode configuration. Cathode strip 200 contains multiple field emitters 210, 220, 230, 240 and emitters 250, 260, 270, 280 for pixels 21 and 20, respectively. This design reduces the failure rate for each pixel, which increases the lifetime of display 192 and manufacturing yield. Since emitters 210, 220, 230, 240 and emitters 250, 260, 270, 280 for pixels 21 and 20, respectively, have an independent resistive layer, the rest of the emitters for the same pixel will continue to emit electrons if one of the emitters on the pixel fails. For example, if field emitter 230 fails, anode strip 290 will continue to be excited by electrons at site 21 occupied by the crossing of anode strip 290 and cathode strip 200 since field emitters 210, 220 and 240 remain. This redundancy will occur at each pixel location except for the highly unlikely occurrence of all field emitters failing at a pixel location. For example, field emitters 250, 260, 270 and 280 would all have to fail in order for pixel location 20 to become inoperable.

The driver compensating circuit of the present invention, which is described below with respect to FIG. 3, may be utilized with just about any addressable matrix display array having variations in pixel uniformity and thus requiring some form of compensation for these variations. However, the remainder of the discussion will be with specific reference to diode field emission display ("DFED") display panels. As previously described, DFED panels have diode-like pixels that efficiently produce light at low level currents on the order of tens of microamps ("$\mu$A"). These pixels' voltage-to-current relationship may have random noise, threshold variations, soft forward knees and several hundred volt turn-on characteristics. The X-Y organization lines (between the anodes and the cathodes) in the display have parasitic capacitances on the order of tens of picofarads ("pf"). The panel gap between anode and cathode may also vary by about ten percent. Further, red, green and blue phosphors may have different efficiencies. All of these variations can cause adjacent or distant discreet pixels to have widely varying light outputs when driven with either constant currents or constant voltages. An object of the present invention is to reduce these variations in light output with techniques that will operate at the required voltages and in the presence of parasitic capacitances that make varying the drive voltages slow and power consumptive. An additional objective is to minimize $CV^2$ (coulombs×volts$^2$) power in the drive scheme electronics. Other display technologies with highly non-linear electrical response characteristics have similar problems and are also solvable using the techniques of the present invention.

Generally, varying characteristics between pixels within display panel 192 are equalized by comparing the charge in a reference pulse from control circuitry to an integral of the current through each pixel. When the integrals are equal, the pixel drive voltage, which is generally constant, is turned off. Timing signals control the integral times such that parasitics have settled before the integral starts so that panel parasitic currents are not measured in the integrals.

Flat panel displays employ an addressing scheme of some sort to allow information a computer (i.e., microprocessor 140) or other device sends to the display to be placed in proper order. Addressing is the means by which pixels are accessed and configured to display the information.

In X-Y multiplex display 192, pixel 20 is selected for illumination when both anode column 292 and cathode row 200 are caused to be selected by anode drivers 180 and cathode drivers 190, respectfully. If display panel 192 is composed of approximately 1 million pixels, the available select time for a particular pixel could be as short as 10 $\mu$sec (for a 480 by 640 VGA screen, three colored anodes per row and a refresh rate of 70 per second). This assumes that whole rows of pixels are addressed with parallel columns of anode drivers. When pixels are not selected, they are held in a state which prevents them from emitting light, and when selected the invention then controls the energy, or power, dissipated in the pixel and thus the amount of light emitted as described below.

To be useful in today's computer and video markets, flat panel displays should be able to create pictures having greys (half-tones) thereby allowing the displays to create graphical images in addition to textual images. Analog, duty-cycle and pulse width modulation techniques (which may be implemented within system 100 in well-known manners) may be used to implement grey-scale operation of a flat panel display.

The first of these is analog control. By varying voltage in a continuous fashion, individual pixels thus excited can be driven to variable intensities, allowing grey-scale operation. The second of these is duty-cycle modulation in which a given pixel is either completely "on" or completely "off" at a given time, but the pixel is so rapidly switched between the "on" and "off" states that the pixel appears to assume a state between "on" and "off." If the dwell times in the "on" or "off" states are made unequal, the pixel can be made to assume any one of a number of grey states between black and white.

Pulse width modulation applies a variable width pulse to the driver circuitry, which is proportional to the desired light output, in order to apply variable energy to the individual pixels. More energy equates to a brighter illumination.

Figure 3:
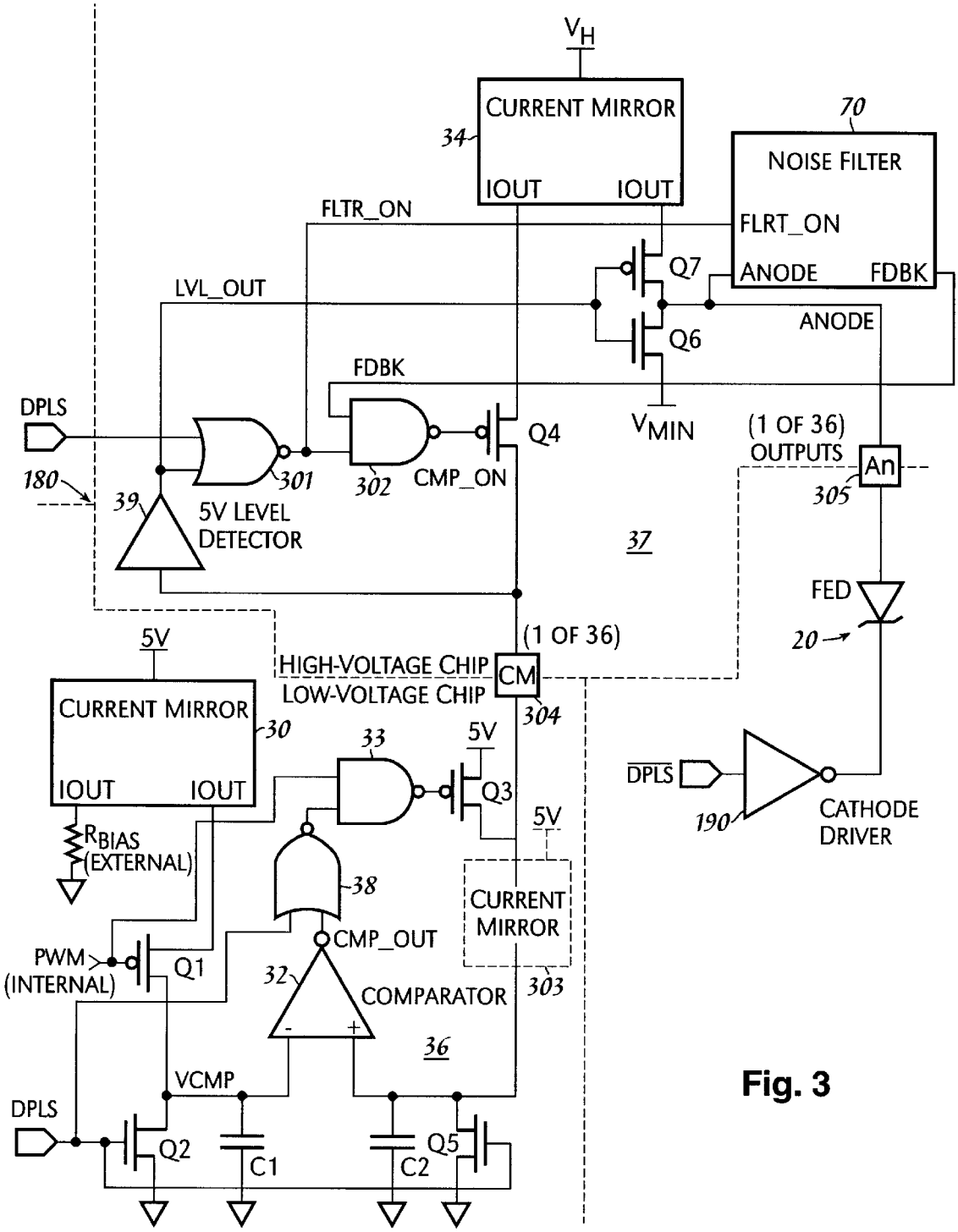
FIG. 3 illustrates an implementation of the present invention in accordance with a preferred embodiment.

Referring next to FIG. 3, there is illustrated anode driver circuit 180 and cathode driver 190 cooperating to selectively activate pixel 20 within display 192. A pulse width modulated ("PWM") signal is received by transistor Q1 from shift register 170 (see FIG. 1). This PWM signal is utilized to integrate a reference current onto capacitor C1 to produce a voltage across capacitor C1 that is proportional to the light output desired from pixel 20. Integrator capacitor C1 is supplied by a reference current produced by current source 30, which, in a preferred embodiment, is equal to the current drawn by the "hottest" pixel in display 192 when a specific select voltage is applied. This current can be determined by measurements on display 192 prior to integration with the proposed electronics. Alternatively, current source 30 may be proportional to the most efficient pixel within display 192, the highest current pixel in display 192 at a given voltage, or may be proportional to any desired reference signal. During manufacturing of display 192, the pixels may be each measured for current at a fixed voltage, with the pixel with the highest current measurement chosen as the reference pixel.

For purposes of illustration, the depictions of transistors Q2, Q5 and Q6 represent p-channel field effect transistors ("FETs"), while the depictions illustrated for transistors Q1, Q3, Q4 and Q7 represent n-channel transistors.

As divided by the dashed lines, in a preferred embodiment of the present invention, components 30, 32, 33, 38, 303, $R_{BIAS}$, Q1, Q2, C1, C2, Q3 and Q5 are placed on a low-voltage integrated circuit chip 36, while components 34, 39, 70, 301, 302, Q4, Q6 and Q7 are mounted within a high-voltage integrated circuit chip 37. Referring to FIG. 8, there is illustrated further detail for anode driver 180, wherein low-voltage chip 36 and high-voltage chip 37 are interconnected and coupled to shift register 170 and pixels 20 within display panel 192. The advantage to this configuration is that the typically more expensive and space consuming high-voltage components are placed on a separate chip from the low-voltage components within chip 36. Preferably, as many components as possible are placed within low-voltage chip 36, while the larger high-voltage components are placed in each of the pair of chips 37. Low voltage components are generally those components that operate at typical logic levels, such as 3 volts and 5 volts. In contrast, high-voltage components are those components that operate at much higher voltages than typical logic levels, such as voltages greater than 25 volts. High-voltage components, as briefly mentioned above, are more expensive and space consuming, since they consume considerably more power, which must be dissipated by various means, such as heat sinks. High-voltage components also undergo greater stresses during operation, thus necessitating unique manufacturing processes and structures for their satisfactory operation.

Figure 4:
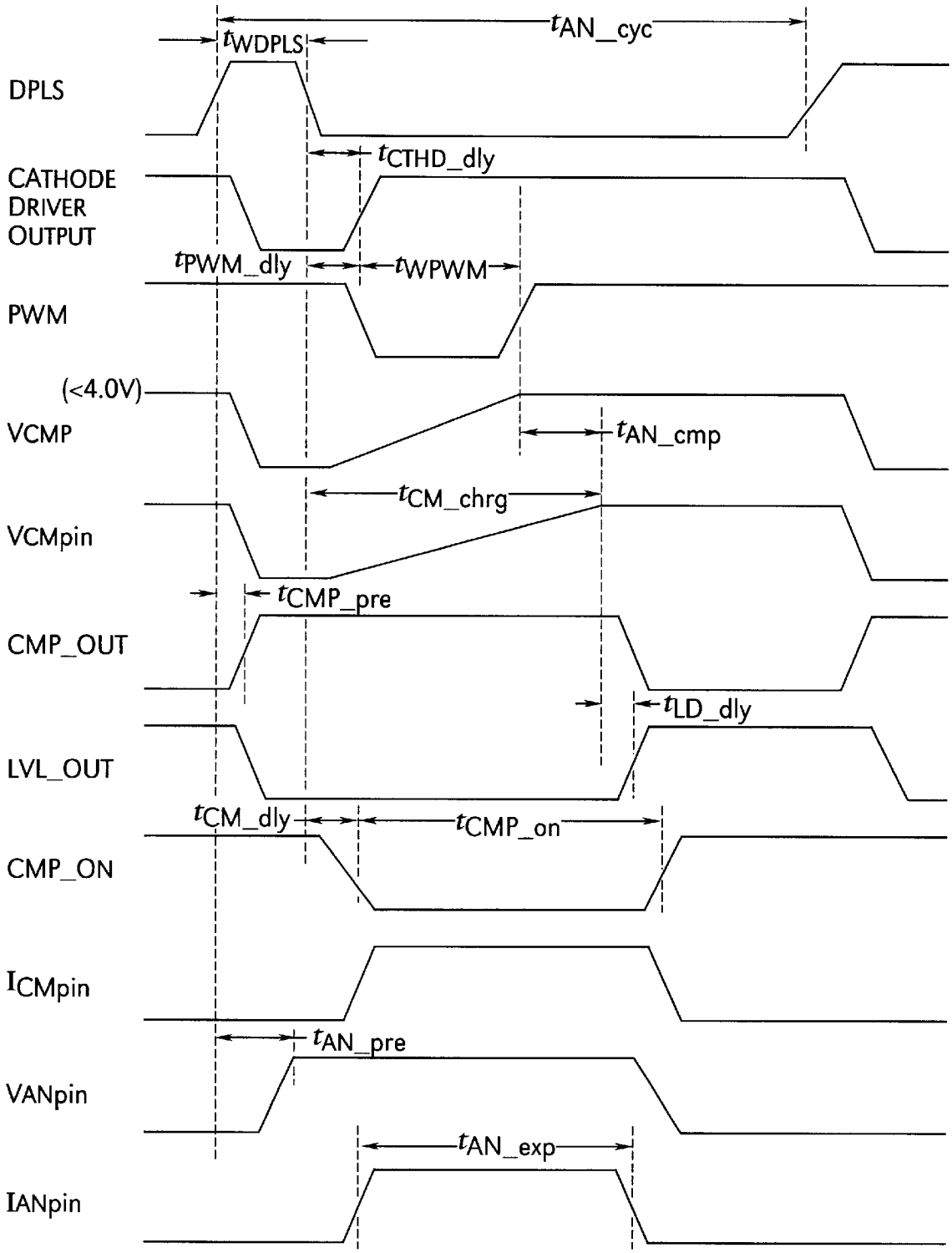
FIG. 4 illustrates timing diagrams associated with the implementation of the present invention.

Returning to FIG. 3, and with reference to the timing diagram illustrated in FIG. 4, an operation of anode driver 180 is discussed hereinafter. FIG. 6 presents typical amounts for the various timing parameters depicted in FIG. 4. Initially, a delay pulse ("DPLS") or "precharge" signal is applied. This signal operates to initialize (discharge) capacitors C1 and C2 to ground by activating transistors Q2 and Q5. Once the inverse of the PWM signal is applied to driver 180, the DPLS signal is removed from driver circuit 180; thus, transistors Q2 and Q5 are deactivated. Since the DPLS signal is high, NOR circuit 301 produces a low signal into NAND circuit 302 which results in a high signal for signal CMP_ON, resulting in transistor Q4 being turned off.

Note that the feedback signal FDBK is normally high, and only goes low when signal FLTR_ON is high and there is a low "glitch" (a low voltage spike) within the anode, resulting in a low signal to terminal ANODE. The function of noise filter 70 will be further discussed below.

The CMP_OUT signal is high since comparator 32 is not producing an inverted output since capacitors C1 and C2 have been grounded. As a result of the DPLS high signal and the high signal for CMP_OUT, NOR circuit 38 produces a low signal into NAND circuit 33. Thus, transistor Q3 remains turned off. This results in a low signal for signal LVL_OUT, since 5 volt level detector 39 does not detect the 5 volt supply through transistor Q3 applied through bidirectional CM pin 304 to high-voltage chip 37.

Pins 304, 305 represent external pins of chips 36 and 37.

The low signal for signal LVL_OUT turns on transistor Q7 and turns off transistor Q6, thus removing minimum voltage $V_{MIN}$ from anode pin 305, which couples high-voltage chip 37 to the anode electrode of pixel 20. However, since transistor Q7 is turned on, the high-voltage $V_H$, which operates to activate current mirror 34, precharges the anode.

Figure 10:
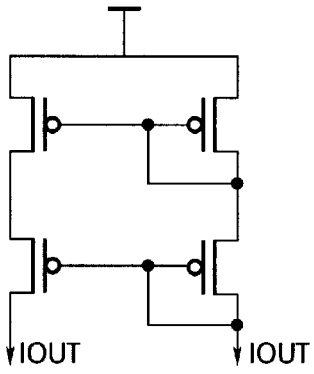
FIG. 10 illustrates a current mirror circuit.

Note that current source 30, current mirror 34 and optional current mirror 303 are conventional current mirror circuits, such as that illustrated in FIG. 10. The essential function of a current mirror circuit is to provide identical currents via outputs IOUT. Thus, if a particular amount of current is being drawn from one of outputs IOUT, then an identical current amount will be produced at the other output IOUT.

Note that the precharging of the anode results in an increase in the voltage supplied to anode pin 305 from voltage $V_{MIN}$ to the required voltage needed to produce emission within pixel 20. However, since the signal DPLS is still activated at a high level, its inverted signal is continuing to be supplied to cathode driver 190, thus preventing cathode driver 190 from activating pixel 20 since an insufficient amount of potential is being supplied to pixel 20 to produce emissions of electrons. Once DPLS goes low, then the inverted signal version of DPLS will result in a lower voltage from cathode drive 190, thus producing the required potential between the anode and cathode of pixel 20 to result in emissions of electrons from the cathode to the anode in order to illuminate pixel 20.

At substantially the same time that the DPLS signal goes low, the pulse width modulated signal PWM also goes low. The PWM signal, resulting from shift register 170, is a function of the desired amount of illumination from pixel 20. As discussed above, if pixel 20 is not as efficient or "hot" as the "hottest" pixel within display 192, it is necessary to drive pixel 20 for a relative period longer than it would take to drive the "hottest" pixel within display 192. This could be accomplished by driving each pixel within display 192 with a PWM signal that varies proportionally to the inefficiency of the particular pixel the PWM signal is being applied to with respect to the "hottest" pixel. However, this would result in a much more complicated circuitry within the drivers. As a result, the present invention provides compensation to the PWM signal, which would be supplied to the "hottest" pixel within display 192, so that the PWM signal is essentially "lengthened" in proportion to the difference in illumination capabilities between pixel 20 and the "hottest" pixel within display 192. As a result of the "lengthened" pulse width modulated signal to pixel 20, pixel 20 is activated for a period of time that results in a substantially identical illumination from pixel 20 as would be produced from the "hottest" pixel within display 192, if it were activated by the non-compensated PWM signal.

When the PWM and DPLS signals go low, NAND circuit 33 continues to supply a high signal to transistor Q3, keeping Q3 turned off. However, the low PWM signal turns on transistor Q1, which allows current from current source 30 to begin integrating (charging) capacitor C1. The current integrating capacitor C1 will be identical to the current flowing through reference resistance $R_{BIAS}$.

In a preferred embodiment of the present invention, the voltage supplied across capacitor C1 may result from current provided by typical current source circuit 30. This current provided by current source 30 may be proportional to an externally provided voltage source applied across reference resistance $R_{BIAS}$. Reference resistance $R_{BIAS}$ may be selected so that the current provided by current source 30 is proportional to the power dissipated within the "hottest" or most efficient, pixel within display panel 192. Thus, pixel 20 may be provided with a compensated energy so that its dissipated energy is equal to the energy dissipated within the "hottest" or the most efficient pixel within display panel 192.

Alternatively, the compensation may be adjusted, by adjusting the capacitance values of capacitors C1 or C2, or by adjusting the reference resistance $R_{BIAS}$, so that the energy dissipated within pixel 20 is greater than or less than the energy dissipated within the "hottest" or the most efficient pixel within display panel 192. Furthermore, resistance $R_{BIAS}$ may be adjusted to any other value to provide a desired current from current source 30. Adjustments may also be made in the various parameters within driver circuit 180 to adjust for various energy consumptions relative to pixels displaying color.

$R_{BIAS}$ may also represent a reference pixel actually within display 192 during operation. In other words, the associated terminal IOUT on current source 30 may be coupled to the anode electrode of the "hottest" pixel within display 192 in order to provide a dynamic compensation of each pixel within display panel 192. One skilled in the art could easily design a circuit capable of monitoring and storing the amount of current dissipated within the "hottest" pixel within display 192.

As noted above, the DPLS signal has previously initialized the voltages across capacitors C1 and C2 to ground. Thus, the now rising voltage, due to the integration of the current from current source 30 through capacitor C1, is greater than the voltage across capacitor C2. This is illustrated in the timing diagram in FIG. 4 by the ramping of the VCMP signal. Note, however, that the signal CMP_OUT continues to be high, since comparator 32 is not producing an inverted signal since the voltage across C1 continues to be greater than the voltage across capacitor C2.

Note also that the signal LVL_OUT continues to be a low signal, which continues to activate transistor Q7, resulting in an increasing voltage at pin 305. As a result of this precharge of the anode, once DPLS goes low, resulting in the inverse of the DPLS signal driving cathode driver 190 (which is equivalent to an inverter), pixel 20 will begin to draw current because there is a sufficient potential between the anode and the cathode of pixel 20 to result in an emission of electrons from the cathode to the anode resulting in an illumination of pixel 20. Thus, current begins to be drawn at pin 305.

Note that the anode and/or cathode electrodes of pixel 20 may be control electrodes within a triode, tetrode, pentode, et seq. structured display.

As a result of the current being drawn through pin 305, current mirror 34 produces an identical current through its other output terminal IOUT through transistor Q4. Transistor Q4 is turned on because signals DPLS and LVL_OUT are both low, resulting in a high signal from NOR circuit 301, which along with the FDBK feedback high signal from noise filter 70, produces a low signal for signal CMP_ON, which turns on transistor Q4. As a result, a mirrored current from current mirror 34 is passed through transistor Q4 through pin 304 to low voltage chip 36. This current is then supplied to capacitor C2 which integrates the current, resulting in a rising voltage across capacitor C2.

If pixel 20 is as efficient as the "hottest" pixel within display panel 192 (or is the "hottest" pixel within display panel 192), than integrating capacitors C1 and C2 will collect charge at a substantially equal rate. Comparator 32 (and/or capacitors C1, C2) may be designed to operate so that comparator 32 removes current from pixel 20 at about the same time that the PWM signal goes "low."

However, if pixel 20 is less efficient, for any one of the various reasons explained above, than the "hottest" pixel within display 192, the energy dissipated within pixel 20 will be at a slower rate. This corresponds to a slower consumption of current from current mirror 34. This slower rate of current is mirrored through integrating capacitor C2, which correspondingly has a slower increase in voltage. Thus, it will take a longer time for capacitor C2 to rise to the voltage present across capacitor C1.

Therefore, voltage $V_H$ is applied to pixel 20 for a time period longer than the period corresponding to the length of the PWM signal. However, once capacitor C2 rises in voltage to substantially the reference voltage across capacitor C1, comparator 32 will produce an inverted signal, i.e., signal CMP_OUT goes low, which is supplied to NOR circuit 38, which produces a high signal to NAND circuit 33. Since by this time the PWM signal has returned to high (since the more efficient or "hottest" pixel within display 192 requires a "shorter" pulse width modulated signal than does pixel 20), NAND circuit 33 produces a low signal turning on transistor Q3, which supplies the 5 volt supply to pin 304. As a result, 5 volt level detector 39 produces a high signal for signal LVL_OUT. This high signal is fed to NOR circuit 301 which produces a low for NAND circuit 302, which results in signal CMP_ON going high and turning off transistor Q4. The result of this whole procedure is that the current being drawn by the anode through pin 305 is no longer mirrored by current mirror 34 to capacitor C2. Furthermore, because signal LVL_OUT has gone high, transistor Q7 turns off, thus removing voltage $V_H$ from pin 305 and turning off pixel 20.

Pin 305 returns to a voltage equal to voltage $V_{MIN}$ as a result of transistor Q6 turning on. Thereafter, the DPLS signal returns to high, thus initializing driver 180 for the next pulse width modulated signal.

Note that current mirror 303 may be optionally inserted between pin 304 and capacitor C2 in order to provide isolation from noise and pin capacitance to capacitor C2. Current mirror 303 operates in a similar manner as current mirror 34 to supply an identical current to capacitor C2 as it is receiving from pin 304.

Thereafter, the Precharge signal is again applied in order to reset capacitors C1 and C2.

Referring next to FIG. 7, there is illustrated a detailed circuit diagram of noise filter 70. In the discussion above regarding the operation of driver 180, noise filter 70 generally does not enter into the operation until a "glitch" is monitored within the voltage supplied to the anode. Such a glitch might occur from various noise sources, and is often caused by "crosstalk" between anode strips 290 and 292. Such crosstalk may be caused by the fluctuations in voltage within one anode strip having an effect on the voltage on an adjoining anode strip. Parasitic capacitances inherent within display panel 192 may also play a role in this noise interference.

As discussed above, the FDBK signal is normally high. This is a result of the fact that transistor 76 pulls one of the terminals of NAND circuit 74 to ground, resulting in a high output from NAND circuit 74.

Voltage V+ are supplied to transistor 71 to transistor 72 and through transistor 73 to transistor 75. Voltage V+ is also utilized to turn on transistor 76.

Normally, when there are no glitches, transistor 72 is turned off. However, once a noise glitch is monitored on pin 305 (such noise glitches are generally low voltage spikes), this will cause transistor 72 to turn on resulting in a momentary supply of voltage V+ to NAND circuit 74. Note that during activation of pixel 20, the FLTR_ON signal is high because signals DPLS and LVL_OUT are both low, thus driving a high signal from NOR circuit 301.

As a result of the two high signals being supplied to NAND circuit 74, a low signal is produced from NAND circuit 74 which is transferred to NAND circuit 302. This will cause signal CMP_ON to go high, momentarily turning off transistor Q4. The result is that current flow through pin 304 to capacitor C2 is momentarily removed during the anode noise glitch. The important result is that when the noise glitch has passed, the same voltage remains on capacitor C2 after the noise glitch as was there immediately prior to the noise glitch. As a result, the integration, which has been temporarily suspended, continues.

The momentary low signal from NAND circuit 74 also turns on transistor 75, which therefore supplies voltage V+ to the base of transistor 72, thus turning off transistor 72 and therefore ending the noise filtering process. The FDBK signal then returns to a high signal.

Figure 11:
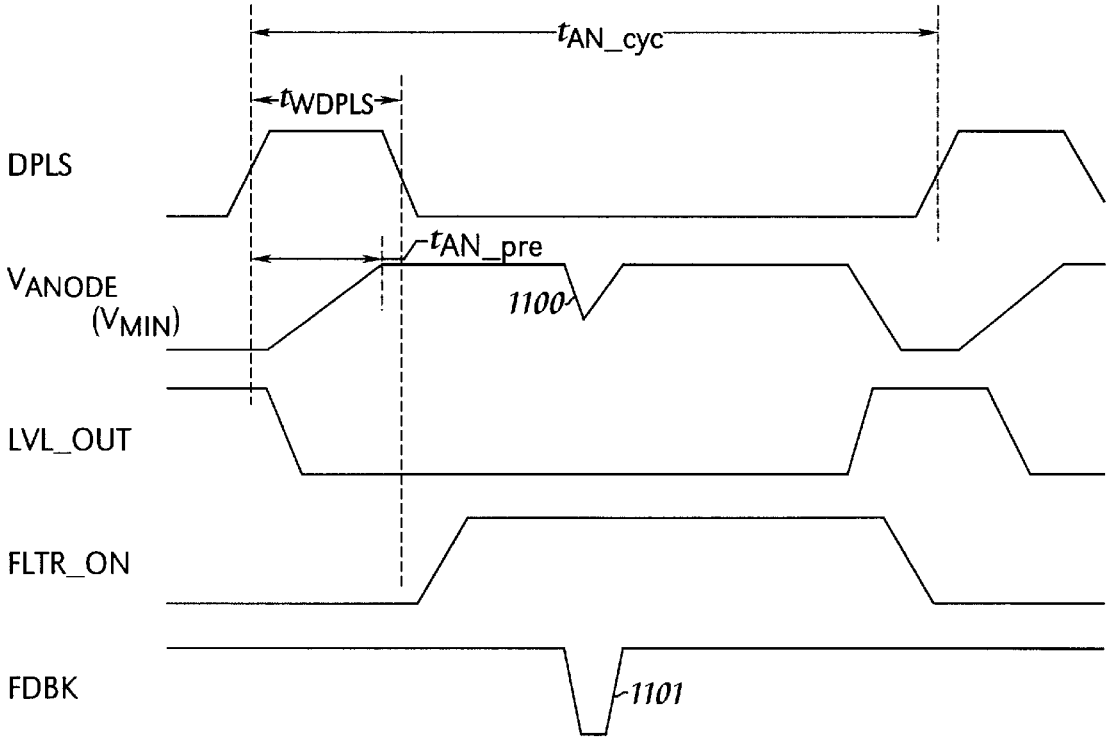
FIG. 11 illustrates timing diagrams associated with the implementation of the noise filter illustrated in FIG. 7.

Referring next to FIG. 11, there is illustrated a timing diagram associated with the implementation of noise filter 70. As noted above, a low glitch on the anode, monitored through pin 305 (noted by label 1100), and caused by adjacent anode switching of voltages (such switched voltages may be on the order of a negative 150 volts) will result in the FDBK signal going low for a period of time (noted by label 1101), resulting in switching transistor Q4 turning off.

Figure 9:
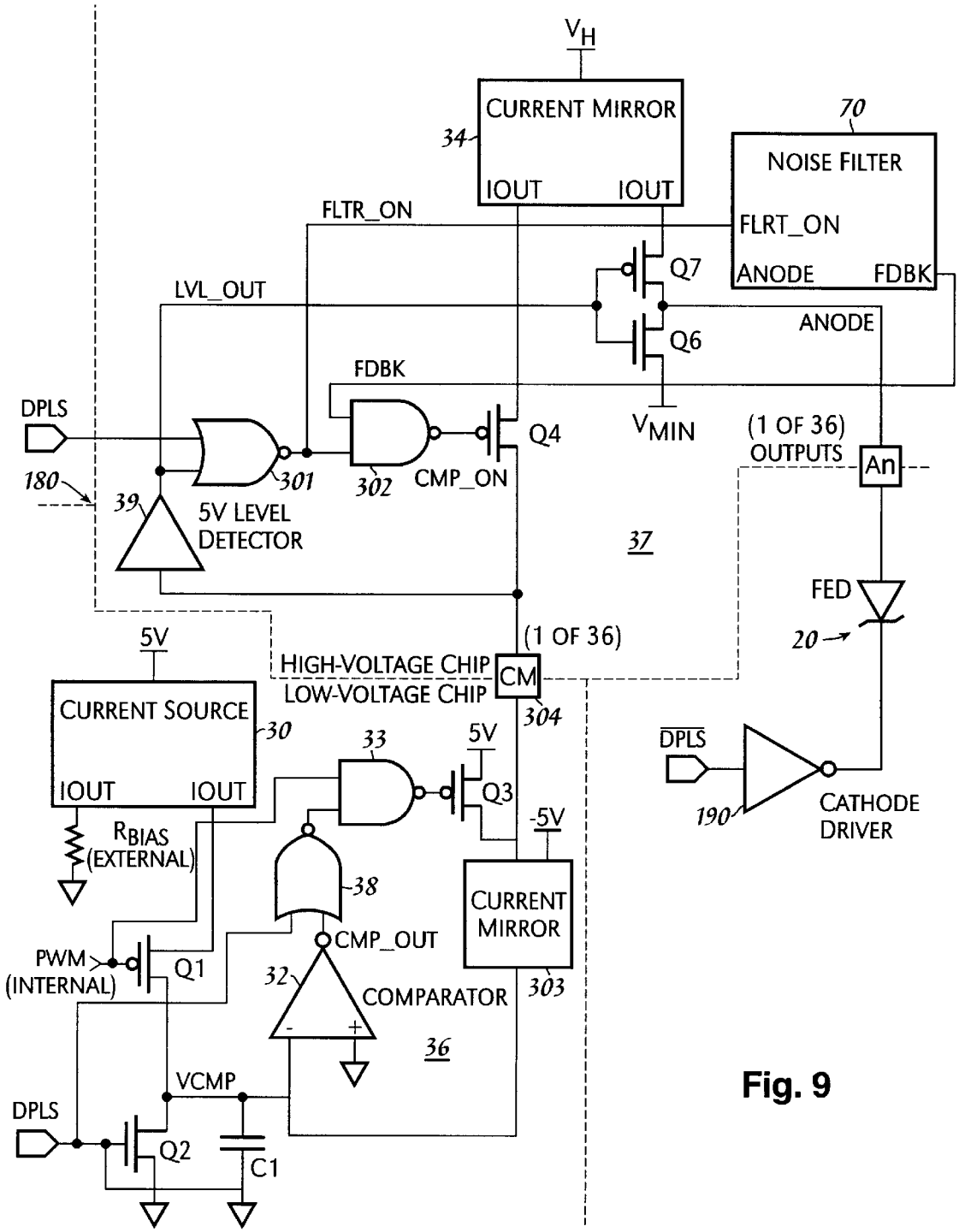
FIG. 9 illustrates an alternative embodiment of the present invention.

Referring next to FIG. 9, there is shown an alternative embodiment of the present invention. Essentially, an almost identical circuit diagram as shown in FIG. 3 is illustrated in FIG. 9, except that the positive terminal on comparator 32 has been coupled to ground, and one of the terminals from current mirror 303 is connected to the upper electrode of capacitor C1. Additionally, the voltage supply to current mirror 303 is a negative 5 volts.

Essentially, driver circuit 180 illustrated in FIG. 9 operates identically to the one illustrated in FIG. 3, except that capacitor C2 is no longer required. Instead, the mirrored current from current mirror 34 is inverted through current mirror 303 because of the negative supply voltage. This inverted current is then essentially summed with the current from current source 30 within the integration process across capacitor C1. Once these two signals are substantially equal (depending upon the design of comparator 32), signal CMP_OUT will go low, as described above.

Although the present invention and its advantages have been described in detail, it should be understood that various changes, substitutions and alterations can be made herein without departing from the spirit and scope of the invention as defined by the appended claims.

What is claimed is:

1. A method for increasing uniformity in screen brightness within a field emission matrix addressable display panel, said method comprising the steps of:

measuring energy dissipation in a first pixel within said display panel; and compensating energy dissipation in a second pixel within said display panel as a function of said measured energy dissipation in said first pixel, wherein said compensating step further comprises the steps of:

integrating a first current signal in response to a received external voltage signal, wherein said first current signal is proportional to said measured energy dissipation;

supplying an energy signal to an electrode associated with said second pixel;

integrating a second current signal wherein said second current signal is proportional to said energy signal; and removing said energy signal from said electrode in response to a comparison of said integrated first and second current signals.

2. The method as recited in claim 1 wherein said removing step removes said energy signal from said electrode when said integrated second current signal is equal to or greater than said integrated first current signal.

3. A system for displaying images on a matrix addressable display panel, said system comprising:

a plurality of pixels arranged within said display panel; and driver means for selectively illuminating said pixels, wherein said driver means further comprises:

means for measuring current dissipation in a first pixel within said display panel; and means for compensating current dissipation in a second pixel within said display panel as a function of said measured current dissipation in said first pixel, wherein said display panel is a diode cold cathode display and wherein said compensating means further comprises:

means for sensing a current supplied to said second pixel within said display;

means for integrating said sensed current;

means for comparing said integrated sensed current to a reference integrated current, wherein said reference integrated current is proportional to said current dissipation in said first pixel; and means for removing said current from said second pixel when said integrated sensed and reference currents are equal.

4. The system as recited in claim 3 wherein said display panel is a diode cold cathode display, said system further comprising:

a microprocessor; and a memory coupled to said microprocessor and to said display.

5. The system as recited in claim 3, wherein illumination of each of said pixels in said display panel is controlled on a pixel-by-pixel basis.

6. The system as recited in claim 3, further comprising:

means for compensating current dissipation in a third pixel within said display panel as a function of said measured current dissipation in said first pixel, wherein compensation of said current dissipation in said third pixel is performed independently of compensation of said current dissipation in said second pixel.

7. The system as recited in claim 3, wherein measuring of current dissipation in the first pixel and compensating of current dissipation in the second pixel are both performed in a dynamic manner.

8. A circuit adaptable for regulating energy supplied to a pixel within a matrix addressable display panel, said circuit comprising:

means for comparing a first voltage signal, which is proportional to a second voltage signal supplied to said pixel, to a reference voltage signal, wherein said second voltage signal supplied to said pixel has a substantially constant voltage level; and means for removing said second voltage signal from said pixel in response to a comparison of said first and reference voltage signals, wherein said removing means turns off said pixel.

9. The circuit as recited in claim 8 wherein said pixel is of a diode configuration having an anode and a cathode.

10. The circuit as recited in claim 8 wherein said pixel is of a triode configuration.

11. The circuit as recited in claim 8, further comprising:

a current integrating means coupled to said comparing means.

12. The circuit as recited in claim 8 wherein said reference voltage signal is supplied by a current integrating means coupled to said comparing means.

13. The circuit as recited in claim 8, further comprising:

means for supplying said reference voltage signal to said comparing means for a period of time proportional to a pulse width modulated signal.

14. The circuit as recited in claim 8 wherein said pixel comprises a field emission device.

15. The circuit as recited in claim 8 wherein said second voltage signal is removed from said pixel when said first voltage signal is equal to or greater than said reference voltage signal.

16. A circuit adaptable for regulating energy supplied to a pixel within a matrix addressable display panel, said circuit comprising:

means for comparing a first voltage signal, which is proportional to a second voltage signal supplied to said pixel, to a reference voltage signal;

means for removing said second voltage signal from said pixel in response to a comparison of said first and reference voltage signals, wherein said removing means turns off said pixel;

a current integrating means coupled to said comparing means; and a current mirror means coupled to said pixel and to said current integrating means.

17. A circuit adaptable for regulating energy supplied to a pixel within a matrix addressable display panel, said circuit comprising:

means for comparing a first voltage signal, which is proportional to a second voltage signal supplied to said pixel, to a reference voltage signal;

means for removing said second voltage signal from said pixel in response to a comparison of said first and reference voltage signals, wherein said removing means turns off said pixel, wherein said reference voltage signal is supplied by a current integrating means coupled to said comparing means; and a current source coupled to said current integrating means, said current source supplying a current proportional to energy required by a "hottest" pixel within said display panel.

18. A driver circuit adaptable for substantially equalizing light emitted from each of a plurality of pixels within a display, said circuit comprising:

means for mirroring a first current supplied to a particular pixel within said display, wherein said mirroring means produces a second current proportional to said first current;

means for integrating said second current;

means for comparing said integrated second current to an integrated reference current; and means for removing said first current from said particular pixel when said integrated second and reference currents are at a predetermined ratio relative to each other.

19. The driver circuit as recited in claim 18 wherein said plurality of pixels are cold cathode field emission devices.

20. The driver circuit as recited in claim 19 wherein said field emission devices include a thin film of diamond as an emissive material.

21. The driver circuit as recited in claim 18 wherein said reference integrated current is switched "on" or "off" by a varying voltage signal.

22. The driver circuit as recited in claim 21 wherein said varying voltage signal is a pulse width modulated signal.

23. The driver circuit as recited in claim 18 wherein said reference integrated current is proportional to a voltage applied to a highest current/constant voltage pixel within said display.

24. The driver circuit as recited in claim 18, further comprising:

means for discharging said integrating means.

25. The driver circuit as recited in claim 18, further comprising:

means for deactivating said integrating means.

26. The driver circuit as recited in claim 18, further comprising:

means for precharging said particular pixel with a potential lower than required for activation of said particular pixel.

27. The driver circuit as recited in claim 18 wherein said display comprises:

a plurality of anode strips, wherein said driver circuit is adaptable for selectively activating any one of said plurality of anode strips;

a plurality of cathode strips arranged in orthogonal relationship with said anode strips;

a phosphor coupled to said anode strips, wherein each of said plurality of pixels is located at an intersection of one of said plurality of anode strips and one of said plurality of cathode strips; and a cathode driver circuit adaptable for selectively activating any of said plurality of cathode strips.

28. A method for activating an electrode within a display panel, said method comprising the steps of:

comparing a first voltage, which is proportional to a second voltage supplied to said electrode, to a reference voltage;

removing said second voltage from said electrode in response to said comparing step so that there is no voltage being supplied to said electrode; and precharging said electrode to a predetermined voltage level prior to supplying said second voltage to said electrode.

29. The method as recited in claim 28, further comprising the step of:

supplying said second voltage to said electrode in response to a selected signal.

30. The method as recited in claim 28, further comprising the step of:

modulating said reference voltage in response to an externally supplied variable signal.

31. The method as recited in claim 28 wherein said second voltage is removed from said electrode when said first voltage is equal or greater than said reference voltage.

32. A method for driving a pixel within a matrix addressable display panel, said method comprising the steps of:

integrating a first current signal in response to a received external voltage signal;

supplying an energy signal to an electrode associated with said pixel;

integrating a second current signal, wherein said second current signal is proportional to said energy signal;

comparing said integrated first and second current signals; and removing said energy signal from said electrode in response to said comparing step.

33. The method as recited in claim 32 wherein said removing step removes said energy signal when said integrated second current signal is equal to or greater than said integrated first current signal.

34. The method as recited in claim 32 wherein said integrating step further comprises the step of:

mirroring a current signal provided to said electrode in order to produce said second current signal.

35. The method as recited in claim 32 wherein said first current signal is proportional to current drawn by a most efficient pixel within said display panel.

36. The method as recited in claims 32, further comprising the step of:

precharging said electrode with a voltage below a threshold level required to activate said pixel.

37. The method as recited in claim 32, further comprising the steps of:

monitoring said energy signal; and temporarily suspending said integrating step in response to said monitoring step.

38. The method as recited in claim 37, wherein said step of monitoring said energy signal further comprises monitoring said electrode associated with said pixel for a noise-related signal.

39. The method as recited in claim 38, wherein said noise-related signal is due to crosstalk between said electrode associated with said pixel and another electrode associated with a second pixel within said matrix addressable display panel.

40. A circuit adaptable for activating a pixel within a matrix addressable display panel, said circuit comprising:

first circuitry for selectively coupling a first voltage signal to an electrode associated with said pixel;

second circuitry for integrating a first current signal proportional to said first voltage signal, wherein said second circuitry further comprises:

a current mirror circuit coupled to said electrode;

a first switching device coupled to said current mirror circuit; and a first capacitor coupled to said first switching device;

third circuitry for comparing said integrated first current signal to a reference voltage signal, said reference voltage signal dependent upon a received modulating signal; and fourth circuitry, coupled to said third circuitry, for modulating said first voltage signal.

41. The circuit as recited in claim 40 wherein said first circuitry further comprises:

a second switching device coupled to said current mirror circuit, wherein said second switching device is responsive to said third circuitry.

42. The circuit as recited in claim 41, further comprising:

a second capacitor for storing said reference voltage signal;

a third switching device coupled to said second capacitor, wherein said third switching device is responsive to said received modulating signal; and a second voltage signal coupled to said third switching device.

43. The circuit as recited in claim 42 wherein said third circuitry further comprises:

a comparator coupled to said first and second capacitors, and wherein said fourth circuitry is coupled to said first switching device.

44. The circuit as recited in claim 40 wherein said second circuitry includes a capacitor for storing said reference voltage signal and for integrating said first current signal.

45. The circuit as recited in claim 40 wherein said second, third, and fourth circuitry are implemented on a low-voltage chip.

46. A circuit adaptable for activating a pixel within a matrix addressable display panel, said circuit comprising:

first circuitry for selectively coupling a first voltage signal to an electrode associated with said pixel;

second circuitry for integrating a first current signal proportional to said first voltage signal;

third circuitry for comparing said integrated first current signal to a reference voltage signal, said reference voltage signal dependent upon a received modulating signal;

fourth circuitry, coupled to said third circuitry, for modulating said first voltage signal; and fifth circuitry for precharging said electrode.

47. The circuit as recited in claim 46 wherein said fifth circuitry further comprises:

a switching device for selectively coupling a second voltage signal to said electrode.

48. A circuit adaptable for driving an electrode within a display panel, said circuit comprising:

means for switching current to said electrode;

means for sampling said current supplied to said electrode;

means adaptable for providing said sampled current to an external circuit; and means, coupled to said switching means, for removing said current from said electrode in response to a signal from said external circuit so that no current is supplied to said electrode, wherein said switching means comprises a FET, said monitoring means comprises a current mirror circuit, and said removing means comprises a FET.

49. The circuit as recited in claim 48 wherein said electrode is part of a field emission device.

50. A circuit adaptable for providing a switching signal operable for switching an energy source to an electrode within a display panel, said circuit comprising:

means adaptable for receiving a first energy signal proportional to an amount of energy supplied from said energy source to said electrode;

first means, coupled to said receiving means, for integrating said first energy signal;

second means for integrating a second energy signal proportional to a received modulating signal;

means for comparing said first and second integrated energy signals; and means for outputting said switching signal in response to said comparison of said first and second integrated energy signals.

51. The circuit as recited in claim 50 wherein said modulating signal is a pulse width modulated signal.

52. The circuit as recited in claim 50 wherein said second energy signal is proportional to an energy signal supplied to a highest current/constant voltage pixel within said display panel.

53. The circuit as recited in claim 50, further comprising:

means for initializing said first and second integrating means.

54. The circuit as recited in claim 50 wherein said first and second integrating means are a capacitor.

55. A circuit comprising:

means for monitoring an energy signal applied to a pixel in a display device; and means for modifying said energy signal applied to said pixel in response to detection of a noise-related signal in said energy signal by said monitoring means.

56. The circuit as recited in claim 55, wherein said monitoring means further comprises a switching means for detecting said noise-related signal, wherein said modifying means further comprises a logical device coupled to said switching means, wherein upon said detection of said noise-related signal, said switching means causes said logical device to output a signal that causes said modification of said energy signal.

57. The circuit as recited in claim 55, wherein said display device is an FED matrix addressable flat panel display, and said noise-related signal is caused by crosstalk between electrodes of said pixel and another pixel within said display.

* * * * *